United States Patent [19]

Perchak

[11] Patent Number: 5,059,950

[45] Date of Patent: Oct. 22, 1991

[54] DEACTIVATABLE ELECTRONIC ARTICLE SURVEILLANCE TAGS, TAG WEBS AND METHOD OF MAKING TAG WEBS

[75] Inventor: Robert Perchak, Dayton, Ohio

[73] Assignee: Monarch Marking Systems, Inc., Dayton, Ohio

[21] Appl. No.: 577,228

[22] Filed: Sep. 4, 1990

[51] Int. Cl.[5] ..... G08B 13/14; H01Q 1/36

[52] U.S. Cl. ..... 340/572; 343/895

[58] Field of Search ..... 340/572, 638; 343/894-895

[56] References Cited

U.S. PATENT DOCUMENTS

| | | | |
|---|---|---|---|
| 3,624,631 | 11/1971 | Chomet et al. | 340/280 |
| 3,631,442 | 12/1971 | Fearon | 340/258 R |
| 3,711,848 | 1/1973 | Martens | 340/280 |
| 3,913,219 | 10/1975 | Lichtblau | 29/592 |
| 4,063,229 | 12/1977 | Welsh et al. | 340/280 |
| 4,208,645 | 6/1980 | Harmon et al. | 337/297 |
| 4,246,563 | 1/1981 | Noerholm | 337/296 |
| 4,567,473 | 1/1986 | Lichtblau | 340/572 |
| 4,745,401 | 5/1988 | Montean | 340/572 |
| 4,835,524 | 5/1989 | Lamond et al. | 340/572 |
| 4,846,922 | 7/1989 | Benge et al. | 156/324 |
| 4,873,506 | 10/1989 | Gurevich | 337/290 |
| 4,920,335 | 4/1990 | Andrews | 340/572 |

FOREIGN PATENT DOCUMENTS

| | | |
|---|---|---|
| PCT/DE850-0098 | 9/1986 | PCT Int'l Appl. . |

*Primary Examiner*—Glen R. Swann, III
*Assistant Examiner*—Thomas J. Mullen, Jr.
*Attorney, Agent, or Firm*—Joseph J. Grass

[57] ABSTRACT

Improved electronic article surveillance tags, webs of such tags and method of making such tags are shown and described. Each tag has a resonant circuit and utilizes a flexible fuse having a supporting film or web of plastics material, a thin coating of a conductive material such as silver to provide a destructible fuse member, and spaced connectors which join the fuse member to spaced-apart circuit portions of the resonant circuit.

17 Claims, 4 Drawing Sheets

DEACTIVATABLE ELECTRONIC ARTICLE SURVEILLANCE TAGS, TAG WEBS AND METHOD OF MAKING TAG WEBS

FIELD OF THE INVENTION

The invention relates to the field of electronic article surveillance.

BACKGROUND OF THE INVENTION

U.S. Pat. No. 3,624,631 granted to Marc Chomet et al on Nov. 30, 1971 discloses a tag with a fused deactivatable resonant circuit. U.S. Pat. No. 3,913,219 granted to George Jay Lichtblau on Oct. 21, 1975 also discloses a fused deactivatable resonant circuit. U.S. Pat. No. 4,835,524 granted to Lee T. Lamond et al on May 30, 1989 discloses a fused deactivatable resonant circuit with an accelerator that promotes fuse action. The Lamond et al patent points out that the prior art fusible link technique requires a deactivating current which is so intense that the radio frequency signal needed to induce it can cause problems in conforming to the regulations and requirements of the United States Federal Communications Commission. This is due to the fact that the prior art approaches for making fused resonant circuits did not take into account the special requirements of such resonant circuits.

Also made of record is a PCT patent application PCT/DE85/00098 which was opened to public inspection on 12 Sept. 1986 in the name of Max E. Reeb; U.S. Pat. No. 3,631,442 granted to Robert E. Fearon on Dec. 28, 1971; U.S. Pat. No. 3,711,848 granted to Henry J. Martens on Jan. 16, 1973; and U.S. Pat. No. 4,063,229 granted to John Welch et al on Dec. 13, 1977.

Other examples of prior art fuses are disclosed in U.S. Pat. No. 4,208,645 granted to Thomas F. Harmon et al on June 17, 1980; U.S. Pat. No. 4,246,563 granted to Olav Noerholm on Jan. 20, 1981; and U.S. Pat. No. 4,873,506 granted to Leon Gurevich on Oct. 10, 1989.

SUMMARY OF THE INVENTION

The purpose of the invention is to provide improved, low-cost, reliable, readily manufacturable tags for use in electronic article surveillance systems.

It is a feature of the invention to provide a multilayer composite flexible fuse as part of a resonant circuit of a flexible tag for an electronic article surveillance system, so that the tag can conform to the article which the tag is required to protect.

It is another feature of the invention to provide an improved fuse as part of a resonant circuit of a tag for an electronic article surveillance system, wherein the fuse is of a construction which can be reliably deactivated and yet the fuse does not substantially or unduly reduce the Q of the resonant circuit.

It is another feature of the invention to provide an improved fuse as part of a resonant circuit of a tag for an electronic article surveillance system, wherein the fuse has low electrical resistance but is nevertheless quick to melt or blow when the resonant circuit is subjected to electrical energy at a predetermined level above the level at which the resonant circuit resonates.

DETAILED DESCRIPTION OF THE PREFERRED EMBODIMENTS

Figure 1:
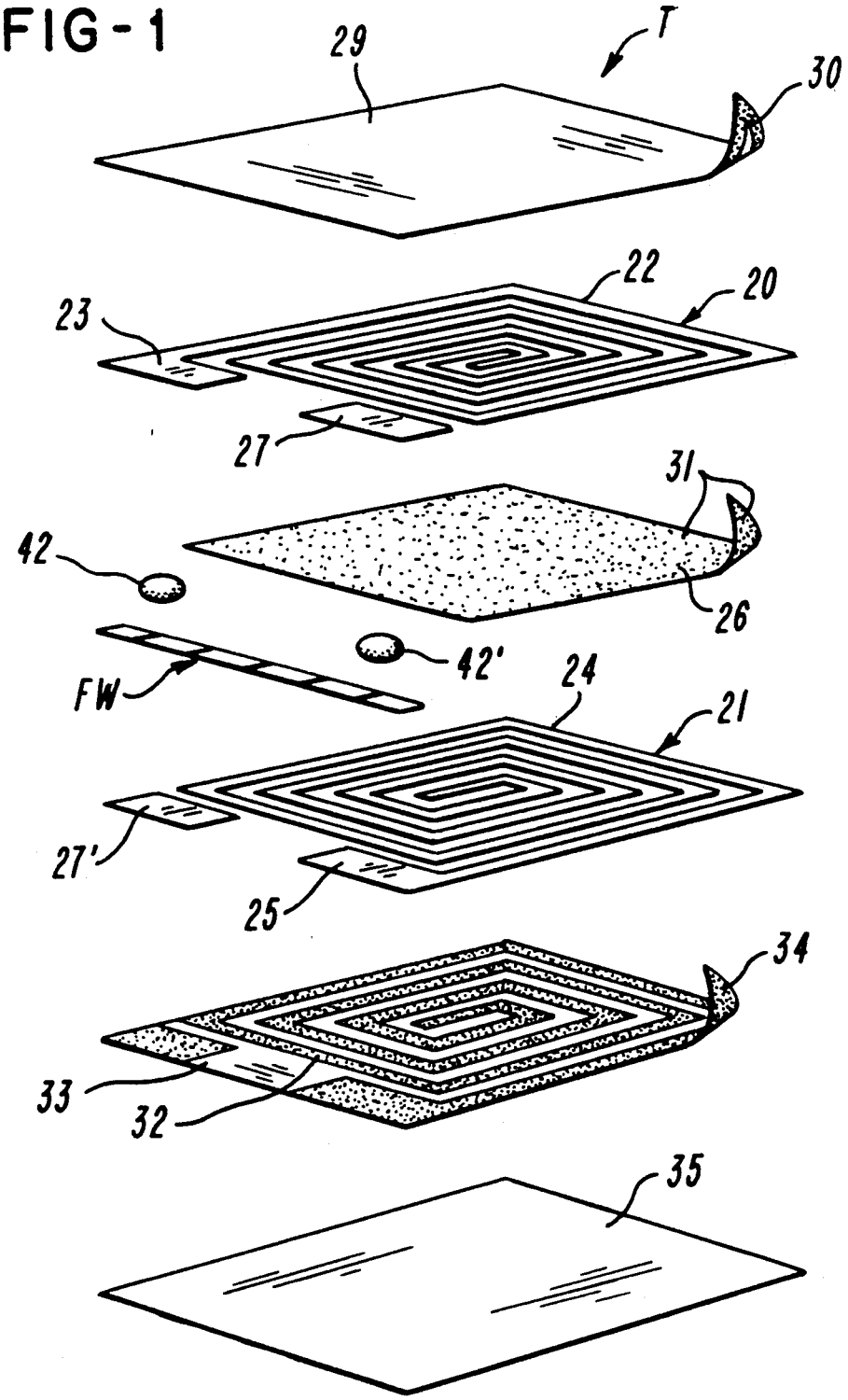
FIG. 1 is an exploded perspective view of a tag in accordance with the invention, showing in particular a portion of fuse web.

A specific embodiment of a tag T is illustrated in FIG. 1. The tag T is flexible so that it can conform to curved or other non-planar merchandise to which it is to be applied. Nevertheless, the resonant circuit RC is not degraded by flexure. Although the expression "tag" is used, this term is broad enough to include labels which are adhesively secured to merchandise, paper tags-which are hung on garments and the like by strings or plastic fasteners. Tags T are useable in conjunction with an electronic article surveillance system of the type disclosed in co-owned U.S. Pat. No. 4,812,822 granted to John F. Feltz et al on Mar. 14, 1989.

With reference to FIG. 1, the tag T is identical to the tag illustrated in co-owned U.S. Pat. No. 4,846,922 granted to S. Eugene Benge et al on July 11, 1989 and is manufactured according to the same method, except as to distinctions noted herein and shown in the accompanying drawings. The resonant circuit RC is shown to be comprised of two flexible circuit portions generally indicated at 20 and 21 connected to each other. The circuit portion 20 includes a spiral conductor 22 having a plurality of turns and terminating at a connector member 23. The circuit portion 21 includes a spiral conductor 24 having a plurality of turns and terminating at a connector member 25. The spiral conductors 22 and 24 are in substantial registry or face-to-face relationship with respect to each other, except that the turns extend in opposite directions. The spiral conductors 20 and 21 are connected to each other by a fuse web generally indicated at FW joined to the connector members 23 and 25 to provide the resonant circuit RC. A sheet of dielectric material 26 is positioned between the spiral conductors 22 and 24, however, the dielectric material 26 terminates short of the connector members 23 and 25. It is seen that a piece of scrap 27 exists in the plane of the circuit portion 20 and that a piece of scrap 27' exists in the plane of the circuit portion 21. The pieces of scrap 27 and 27' result from the cutting out of the circuit portions 20 and 21 and do not form part of the resonant circuit RC. A sheet or layer 29 of preferably opaque flexible material is adhesively adhered to the circuit portion 22 by pressure sensitive adhesive 30. The sheet 29 protects the resonant circuit RC, shields it -from view and is printable in a printer either before and/or after assembly of the tag T. Adhesive 31 on both sides of the dielectric material 26 adheres the dielectric material 26 to the circuit portions 20 and 21. A patterned coating of adhesive 32 exists on one surface of a sheet 33 of flexible material and a continuous coating of pressure sensitive adhesive 34 exists on the opposite surface. The tag T can be adhered to an article to be protected by means of the adhesive 34. The sheet 33 comprises a carrier for the flexible resilient circuit RC. A sheet of flexible release-coated backing paper 35 is releasably adhered to the adhesive 34 on the sheet.

Figure 2:
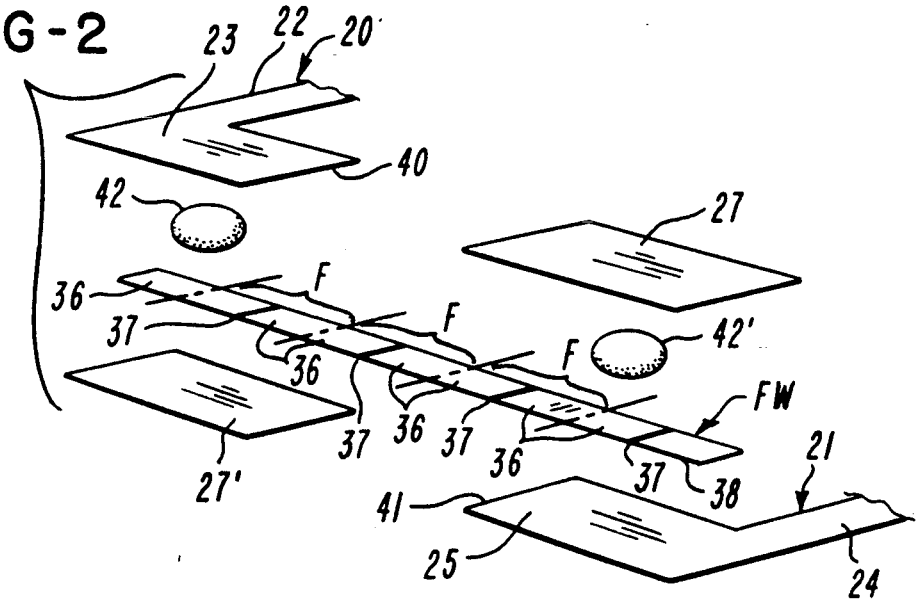
FIG. 2 is an enlarged exploded fragmentary view showing the manner in which circuit portions of the resonant circuit are connected through a fuse.
Figure 9:
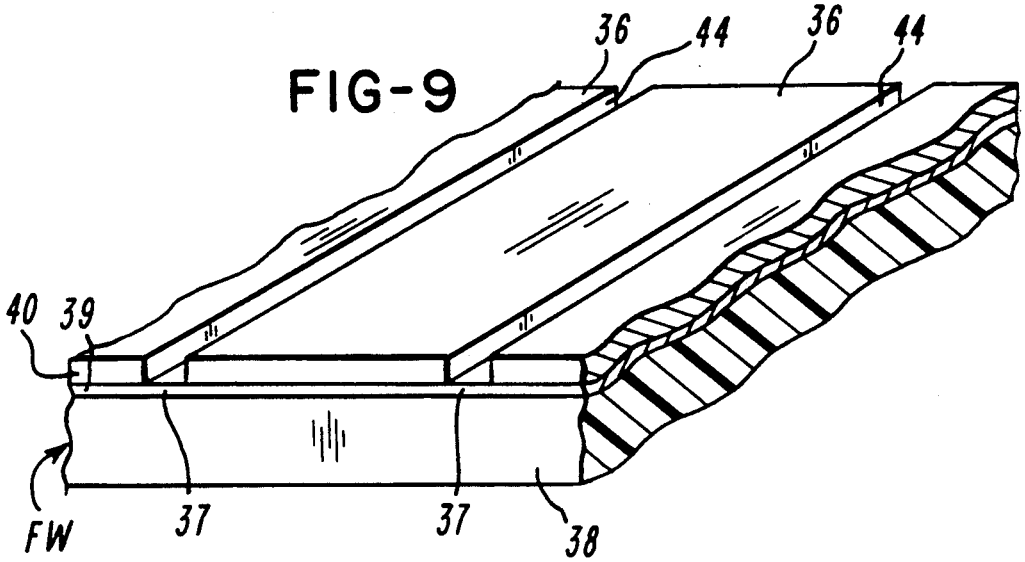
FIG. 9 is an enlarged perspective fragmentary view showing the composite fuse web.

With reference to FIG. 2, the connection between the connector members 23 and 25 through a fuse web FW is illustrated in greater detail than in FIG. 1. The fuse web FW is shown to be disposed in a plane between the planes of the circuit portions 20 and 21. The fuse web FW includes pairs of connectors 36. There is a fuse member 37 between each adjacent pair of connectors 36. The fuse web FW is shown in greater detail in FIG. 9. As shown, the fuse web FW is comprised of a web of flexible non-conductive plastics material 38 such as polyester film on which there is a thin coating 39 of a conductive material such as silver. There is a relatively thick coating 40 of a conductive material such as copper applied to the coating 39. The portion of the coating 39 which bridges or connects adjacent but spaced-apart connectors 36 constitutes the fuse member 37.

With reference to FIG. 2, a fuse F is considered to include a fuse member 37, one-half of both adjacent connectors 36 and the adjacent film 38 with its coating 39. As is evident from FIG. 2, the fuse web FW includes a plurality of fuses F. As shown, the fuse members 37 occur at equally spaced-apart intervals longitudinally of the fuse web FW. The distance between the center of one fuse member 37 and the center of the next fuse member 37 is considered to be the pitch P. The pitch P is preferably somewhat less than the longitudinal distance between edge 40 of the connector member 23 and edge 41 of the connector member 25. Therefore, there is no need to register the fuse web FW with the connector members 23 and 25 to assure that one fuse member 37 registers with gap therebetween. However, if desired the pitch P of the fuse members 37 could be arranged so that a single fuse member 37 is always positioned in the gap between edges 40 and 41.

Figure 4:
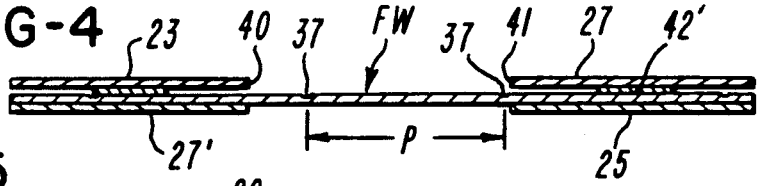
FIG. 4 is a sectional diagrammatic view showing the various layers of the tag.
Figure 3:
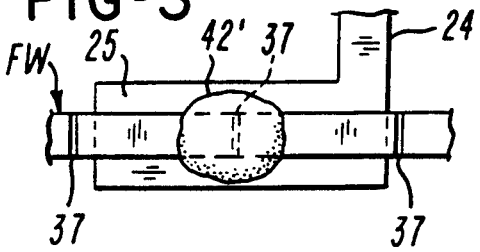
FIG. 3 is a top plan view showing the manner in which one circuit portion is welded to the fuse web.

As shown in FIG. 2, the fuse web FW is connected to the connector member 23 by welding material 42 and the fuse web FW is connected to the connector member 25 by welding material 42'. The welding material 42 is between the connector member 23 and the connector 36. However, the welding material 42' is adhered to the connector 36 and flows beyond the side edges of the fuse web FW and is adhered to the connector member 25 as best shown in FIG. 3, so a good electrical connection is achieved even though the plastics film 38 is positioned against the surface of the connector member 25. FIG. 4 is a sectional view taken through the connectors 23 and 25, but showing the fuse web FW in elevation. The welding material 42 and 42' can be the same as disclosed in U.S. Pat. No. 4,846,922, at columns 11 and 12.

Figure 5:
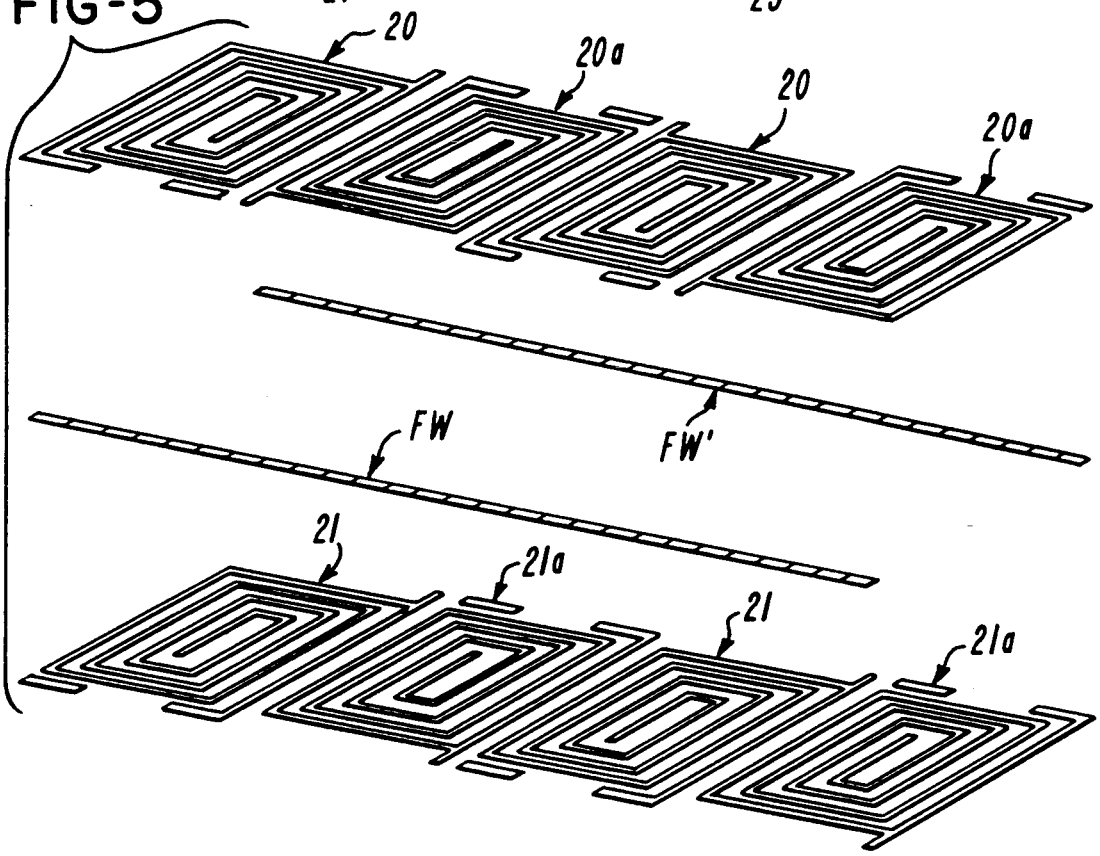
FIG. 5 is an exploded fragmentary perspective view of a single web of resonant circuits shown with a pair of fuse webs.

FIG. 5 shows a series of staggered circuit portions 20 and **20*a* in one plane and a series of staggered circuit portions 21 and 21*a* in a different plane. Fuse webs FW and FW' are disposed between the circuit portions 20 and 21, and 20*a* and 21*a*, respectively. The fuse web FW is for the circuit portions 20 and 21 and the fuse web FW, is for the circuit portions 20*a* and 21*a***. The staggered arrangement results from the method of manufacture disclosed in U.S. Pat. No. 4,846,922 by which the resonant circuit tags T are made.

The fuse web FW (and the fuse web FW') according to the invention is made by starting out with a plastics film 38 coated with a thin coating of a conductive layer or material 39 such as silver. The layer 39 is shown exploded away from the film 38 in FIG. 6.

Figure 6:
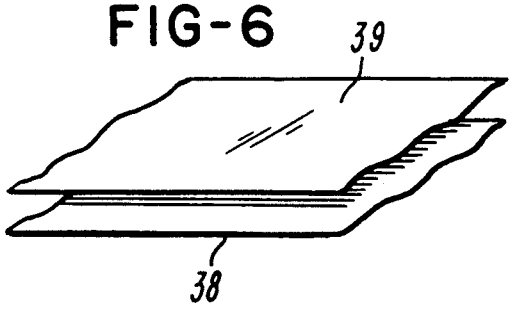
FIG. 6 is an exploded perspective view showing a plastics film with a coating thereon.
Figure 7:
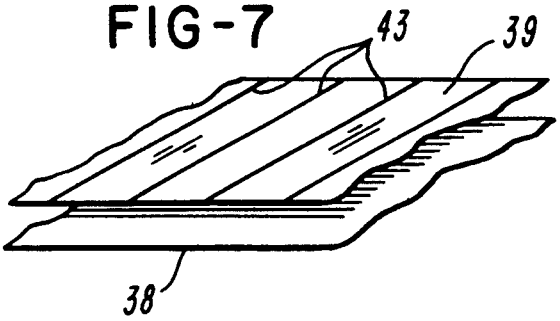
FIG. 7 is a view similar to FIG. 6, but showing a "resist" as having been applied to the conductive coating.
Figure 8:
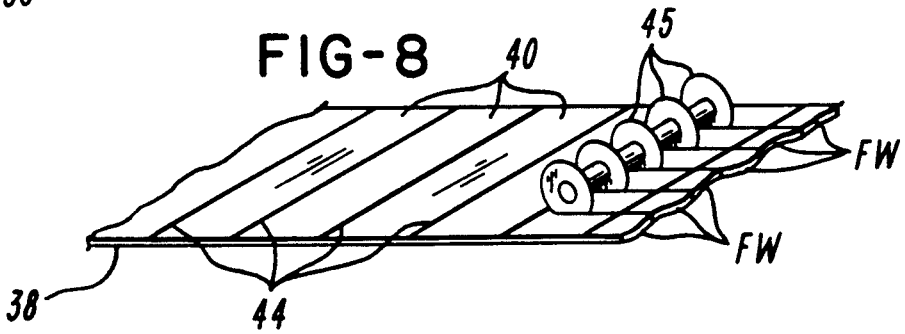
FIG. 8 is a perspective view of a wide composite fuse web being slit into narrow composite fuse webs.

FIG. 7 is like FIG. 6 except that the conductive layer 39 is printed or coated with a pattern of equally spaced-apart lines of a "resist" 43. The film 38 with its layer 39 is then coated with a relatively thick coating 40 of conductive material such as copper. The coating 40 is resisted by the resist 43 leaving parallel gaps 44 in the coating 40. The wide composite fuse web FW' thus formed is then slit into a series of narrow fuse webs FW by means of equally spaced-apart knives 45.

Each gap 44 spaces apart adjacent connectors 36. That portion of the conductive material 39 which connects or bridges the gap 44 between adjacent connectors 36 defines the fuse member 37.

Figure 10:
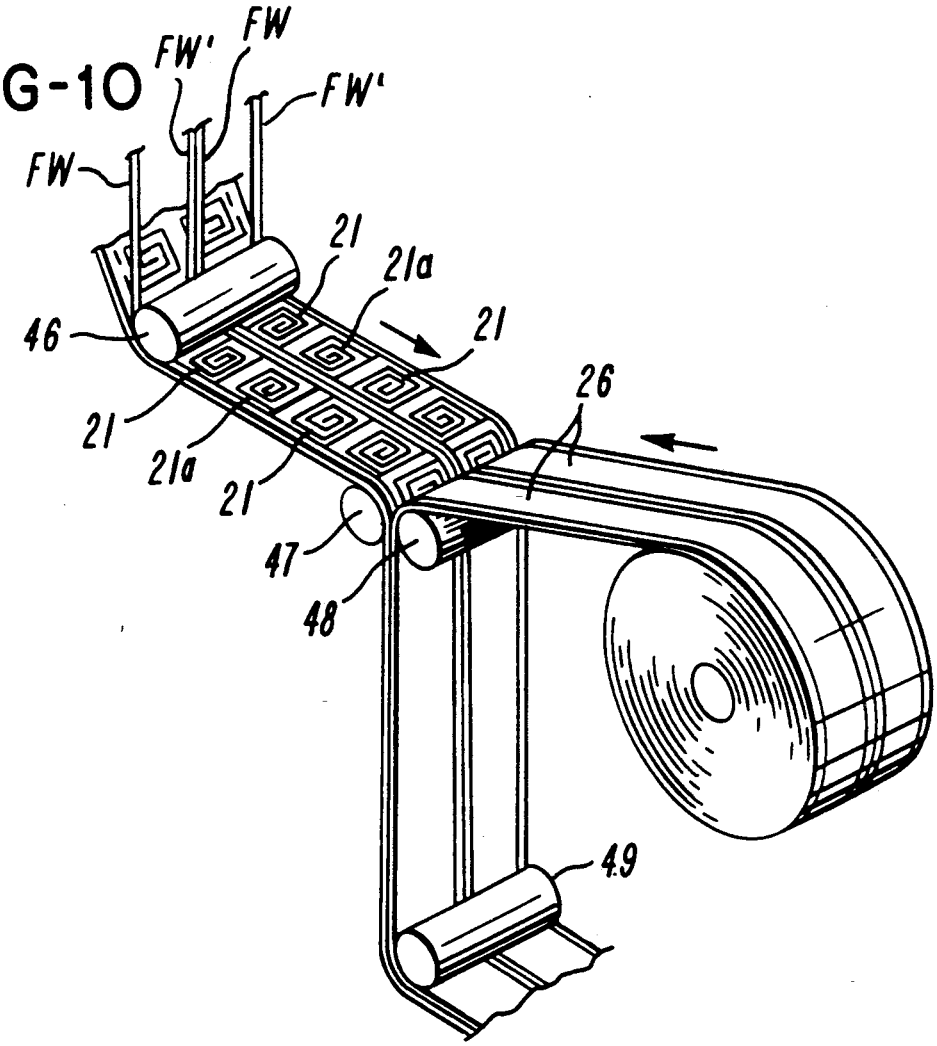
FIG. 10 is a fragmentary perspective view showing the manner in which the fuse webs are positioned relative to the resonant circuit during manufacture thereof.

FIG. 10 shows a portion of the preferred process for making a double web of fused deactivatable tags. The circuit portions 21 and **21*a* pass about a roll 46 along with fuse webs FW and FW!. Webs with dielectric material 26 and the circuit portions 21 and 21*a* pass between the nip of the cooperating rolls 47 and 48. From there this combination passes about a roll 49** which is eventually united with other circuit portions in the manner of U.S. Pat. No. 4,846,922.

Figure 11:
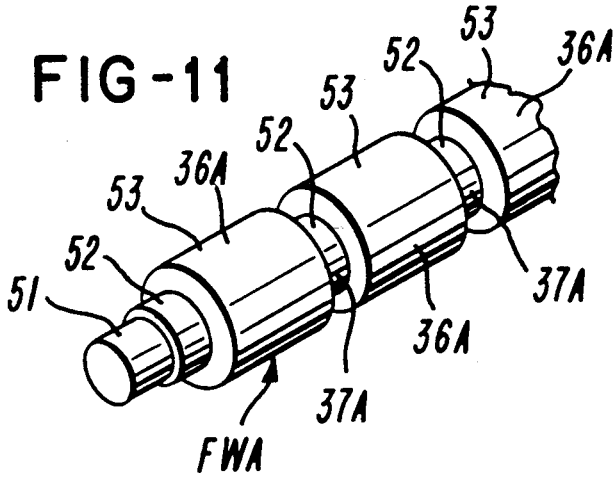
FIG. 11 is a perspective view showing an alternative embodiment of fuse web in the form of a composite thread.

An alternative fuse web FWA is shown in FIG. 11. The fuse web FWA has a central core of polyester plastics material 51 which has a continuous thin coating of a conductive material 52 such as silver over which there is a relatively thick coating 53 of a conductive material such as copper. The fuse member 37A is formed by the conductive material 52 which bridges or connects adjacent connectors 36A. The fuse web FWA is threadlike and is used- in the same way as the fuse web FW is used.

It should be noted that the fuse member 37 (37A) has low electrical resistance and is relatively short. Low electrical resistance is important so that the Q of the circuit is not substantially or unduly affected. The lower the resistance, the smaller the reduction in the circuit Q. Typical preferred total electrical resistance for the fuse member 37 (37A) is in the order of 0.2 Ohm and more preferably about 0.1 Ohm. The fuse member 37 (37A) is preferably short, but not too short. A typical fuse member length is 0.003 inch (0.076 mm). The preferred range of fuse member length is between 0.002 inch (0.05 mm) and 0.004 inch (0.15 mm). The longer the fuse member 37 (37A), the higher the resistance. If the fuse member 37 (37A) is too short, heat will be dissipated to the connectors 36 (36A) when the excess energy is applied for deactivation. A typical desired time for the fuse member 37 (37A) to be destroyed, that is to meet or "blow" is in the order of 100 microseconds, although somewhat longer or shorter times are tolerable. The fuse member 37 (37A) is destroyed by melting and/or vaporizing when excess energy is applied to the resonant circuit, namely by second energy level signal which is of higher energy than a first energy level signal used to operate the resonant circuit.

It will be appreciated that other coatings can be used for the fuse webs FW, FW' and FWA. For example, the layer or coating 39 can be copper and the layer or coating 40 can be tin; the layer 39 can be copper and the layer 40 can be indium; the layer 39 can be copper, and the layer 40 can be silver, and so on. The film 38 can be made of materials other than polyester, mylar for example. The coating 39 is preferably less than 1000 Angstrom Units thick and even more preferably between 200 and 600 Angstrom Units thick. In one specific example, the coating 39 is 400 Angstrom Units thick. The coating 40 is substantially thicker than the coating 39 so that the connectors 36 can be welded to the connector members 23 and 25 without destroying the connectors 36 or any other part of the fuse F. A typical range of thickness for the coating or layer 40 is from 0.00005 inch (0.00127 mm) to 0.0005 inch (0.0127 mm).

The invention provides a readily manufacturable fused resonant circuit wherein the Q of the circuit is not substantially or unduly affected. The fuse F does effect certain degradation of the Q, for example a circuit without the fuse F can have a circuit Q between 50 and 60 and the fuse F can reduce the Q to about 35. Yet the resonant circuit RC is not substantially or unduly affected because it is still detectable in the interrogation zone of the electronic article surveillance system by signals within the limits set by the Federal Communication Commission. The Q of the circuit is defined as $Q=2\pi$ maximum energy stored/total energy lost per period.

Other embodiments and modifications of the invention will suggest themselves to those skilled in the art, and all such of these as come within the spirit of this invention are included within its scope as best defined by the appended claims.

What is claimed is:

1. A flexible deactivatable tag for use in an electronic article surveillance system, the tag comprising: a flexible carrier, a flexible resonant circuit- on the carrier and responsive to receipt of a first energy level signal to emit an alarm signal to indicate the presence of the resonant circuit in an interrogation zone, wherein the resonant circuit includes two circuit portions, a flexible fuse including a film of non-conductive plastics material, a coating of conductive material on the film and spaced-apart connectors on the conductive material, wherein the conductive material which connects adjacent connectors constitutes a fuse member, wherein the fuse member is responsive to a second energy level signal at an energy level higher than the first energy level signal to cause deactivation of the resonant circuit, and means for electrically connecting the circuit portions through the fuse.

2. The tag as defined in claim 1, wherein the fuse member is less than 1000 Angstrom Units thick.

3. A flexible deactivatable tag for use in an electronic article surveillance system, the tag comprising: a flexible carrier, a flexible resonant circuit on the carrier and responsive to receipt of a first energy level signal to emit an alarm signal to indicate the presence of the resonant circuit in an interrogation zone, wherein the resonant circuit includes two circuit portions, a flexible fuse including a film of non-conductive plastics material, a coating of conductive material on the film and spaced-apart connectors on the conductive material, wherein the conductive material which connects adjacent connectors constitutes a fuse member, wherein the fuse member is responsive to a second energy level signal at an energy level higher than the first energy level signal to cause deactivation of the resonant circuit, wherein the fuse member has an electrical resistance of less than 0.3 Ohms and is relatively short to prevent substantial reduction in the Q of the resonant circuit from being substantially or unduly affected, and means for electrically connecting the circuit portions through the fuse.

4. The tag defined in claim 3, wherein the fuse member is less than 1000 Angstrom Units thick.

5. A flexible deactivatable tag for use in an electronic article surveillance system, the tag comprising: a flexible carrier, a flexible resonant circuit on the carrier and responsive to receipt of a first energy level signal to emit an alarm signal to indicate the presence of the resonant circuit in an interrogation zone, wherein the resonant circuit includes two circuit portions, a flexible fuse including a film of non-conductive plastics material, a coating of conductive material on the film and spaced-apart connectors on the conductive material, wherein the conductive material which connects adjacent connectors constitutes a fuse member, wherein the fuse member is responsive to a second energy level signal at an energy level higher than the first energy level signal to cause deactivation of the resonant circuit, and wherein the fuse member is of low electrical resistance and is less than 0.005 inch long.

6. The tag defined in claim 5, wherein the fuse member is less than 1000 Angstrom Units thick.

7. The tag defined in claim 5, wherein the conductive material comprises silver.

8. The tag defined in claim 5, wherein the connectors comprise one of copper and silver.

9. The tag defined in claim 5, wherein the conductive material comprises silver and the connectors comprise one of silver and copper.

10. The tag defined in claim 5, wherein the conductive material is comprised of silver, the connectors are comprised of copper, and the length of the fuse member is between 0.002 inch and 0.004 inch.

11. The tag defined in claim 1, wherein the thickness of the conductive material is between 200 and 600 Angstrom Units.

12. A flexible deactivatable tag for use in an electronic article surveillance system, the tag comprising: a flexible carrier, a flexible resonant circuit on the carrier and responsive to receipt of a first energy level signal to emit an alarm signal to indicate the presence of the resonant circuit in an interrogation zone, wherein the resonant circuit includes two circuit portions, a flexible fuse including a film of non-conductive plastics material, a coating of conductive material on the film and spaced apart conductors on the conductive material, wherein the conductive material which connects adjacent conductors constitutes a fuse member, wherein the fuse member is responsive to a second energy level signal at an energy level higher than the first energy level signal to cause deactivation of the resonant circuit, wherein the circuit portions are disposed in spaced planes, each circuit portion having a connector member, wherein the fuse member is disposed in a plane between the planes of the circuit portions, wherein one conductor is in face-to-face disposition with respect to one connector member and the plastic film is in face-to-face disposition with respect to the other connector member, and means for electrically connecting the connectors to the connector members so that the resonant circuit is made through the fuse member.

13. The tag defined in claim 12, wherein the electrical connecting means includes welding material which bridges the other connector with the other connector member.

14. A web of flexible deactivatable tags, the tags being for use in an electronic article surveillance system, comprising: a flexible tag web having a series of spaced flexible resonant circuits, each of said resonant circuits being responsive to receipt of a first energy level signal to indicate the presence of the resonant circuit in an interrogation zone, each resonant circuit including two spaced-apart circuit portions, a flexible supporting web composed of non-conductive plastics material, a coating of conductive material on the supporting web and a series of longitudinally spaced conductive connectors joined to the conductive material, wherein the conductive material which connects each adjacent pair of conductors constitutes a fuse member, wherein each fuse member is responsive to a second energy level signal at an energy level higher than the first energy level signal to cause deactivation of the resonant circuit, wherein the supporting web, the conductive material and the spaced connectors constitute a flexible fuse web having the fuse members spaced therealong, the fuse web being positioned adjacent the resonant circuits and between the circuit portions of each circuit, and means for electrically connecting the circuit portions of each resonant circuit through connectors and an intervening fuse member of the fuse web.

15. A web of flexible deactivatable tags, the tags being for use in an electronic article surveillance system, comprising: a flexible tag web including a series of spaced flexible resonant circuits, each of said resonant circuits being responsive to receipt of a first energy level signal to indicate the presence of the resonant circuit in an interrogation zone, each resonant circuit including two spaced-apart circuit portions, a flexible supporting web composed of non-conductive plastics material, a coating of conductive fuse material on the supporting web and a series of longitudinally spaced conductive connectors joined to the conductive material, wherein the conductive material which connects each adjacent pair of conductors constitutes a fuse member, wherein each fuse member is responsive to a second energy level signal at an energy level higher than the first energy level signal to cause deactivation of the resonant circuit, wherein the supporting web, the conductive material..and the spaced connectors constitute a flexible fuse web having the fuse members spaced therealong, the fuse web being randomly positioned adjacent the resonant circuits and between the circuit portions of each circuit, wherein the pitch of the fuse members is less than the space between the circuit portions of any resonant circuit, and means for electrically connecting the circuit portions of each resonant circuit through adjacent connectors and an intervening fuse member of the fuse web.

16. Method of making deactivatable tags for use in an electronic article surveillance system, comprising the steps of: providing a tag web having a series of spaced resonant circuits with each resonant circuit being responsive to receipt of a first energy level signal to emit an alarm signal to indicate the presence of the resonant circuit in an interrogation zone, the tag web being detachable between adjacent resonant circuits to provide a plurality of tags, each resonant circuit including two spaced-apart circuit portions, providing a flexible web composed of plastics material and having a coating of conductive material and a series of spaced connectors coated onto the conductive material along the length of the web, wherein the conductive material which connects each adjacent pair of connectors constitute a fuse member responsive to a second energy level signal at an energy level higher than the first energy level signal to cause deactivation of the resonant circuit, wherein the supporting web, the fuse material and the spaced connectors constitutes a fuse web having the fuse members spaced therealong, randomly positioning the fuse web adjacent the resonant circuits and between the circuit portions of each circuit, wherein the pitch of the fuse members is less than the space between the circuit portions of any resonant circuit, and connecting the circuit portions of each resonant circuit through connectors and an intervening fuse member of the fuse web.

17. Method of making deactivatable tags for use in an electronic article surveillance system, comprising the steps of: providing a tag web having a series of spaced resonant circuits with each resonant circuit being responsive to receipt of a first energy level signal to emit an alarm signal to indicate the presence of the resonant circuit in an interrogation zone, the tag web being detachable between adjacent resonant circuits to provide a plurality of tags, each resonant circuit including two spaced-apart circuit portions, providing a flexible web composed of plastics material and having a coating of conductive material and a series of spaced connectors coated onto the conductive material along the length of the web, wherein the conductive material which connects each adjacent pair of connectors constitutes a fuse member responsive to a second energy level signal at an energy level higher than the first energy level signal to cause deactivation of the resonant circuit, wherein the supporting web, the conductive material and the spaced connectors constitute a fuse web having the fuse members spaced therealong, positioning the fuse web adjacent the resonant circuits and between the circuit portions of each circuit, and connecting the circuit portions of each resonant circuit through connectors and an intervening fuse member of the fuse web.

* * * * *

UNITED STATES PATENT AND TRADEMARK OFFICE

CERTIFICATE OF CORRECTION

PATENT NO. : 5,059,950

DATED : October 22, 1991

INVENTOR(S) : Robert Perchak

It is certified that error appears in the above-identified patent and that said Letters Patent is hereby corrected as shown below:

Column 2, line 22, "circuit" should be --circuits--. Column 4, line 5, "FW," should be --FW'--; line 30, "FW!" should be --FW'--. Column 7, line 41, after "conductive" --fuse-- should be deleted; line 50, the two periods after "material" should be deleted. Column 8, line 22, "fuse" should be --conductive--.

Signed and Sealed this

Fifteenth Day of June, 1993

*Attest:*

Michael K. Kirk

MICHAEL K. KIRK

*Attesting Officer*

*Acting Commissioner of Patents and Trademarks*